United States Patent [19]

Klein

[11] 3,953,939

[45] May 4, 1976

[54] MOVABLE GRILL GUARD

[76] Inventor: Charles Klein, Sierra Madre 110, Mexico City, Mexico

[22] Filed: Feb. 26, 1974

[21] Appl. No.: 445,947

[52] U.S. Cl. ..... 49/56
[51] Int. Cl.[2] ..... E06B 3/68
[58] Field of Search ..... 49/56, 50, 57, 67, 63

[56] References Cited

UNITED STATES PATENTS

| | | | |
|---|---|---|---|
| 1,745,661 | 2/1930 | Dittrich | 49/56 X |
| 1,960,015 | 5/1934 | Kitzelman | 49/56 X |
| 2,668,729 | 2/1954 | Watters | 49/50 X |
| 3,667,161 | 6/1972 | Sassano | 49/56 |

*Primary Examiner*—Philip C. Kannan

[57] ABSTRACT

A grill is attached over an opening in a building. The top of the grill, which is connected together by a cross member, is securely attached to the side of the building. The lowermost portion of the grill, which is also connected by a cross member, pivots about the upper or a central cross member. The lower portion of the grill is held over the opening and against the side of the building by a quick release locking mechanism operated from inside the building. Upon release of the quick release locking mechanism, the lower portion of the grill will be allowed to swing outward so that a person may leave the building through the opening in case of an emergency.

8 Claims, 23 Drawing Figures

MOVABLE GRILL GUARD

BACKGROUND OF THE INVENTION

This invention relates to security devices, and more particularly, to grill guards for securing an opening in a building to prevent entry into the building through the opening, yet permitting a quick exit from the building through the opening in cases of emergency such as fire.

BRIEF DESCRIPTION OF THE PRIOR ART

Many types of security devices have been designed for businesses and homes to prevent an unauthorized entry therein by burglars, vandals, rapists or other unwelcome people. Though many other types of systems have been devised, the one common method for preventing unauthorized entry through windows is by use of some type of burglar bars. Normally these burglar bars were bolted very securely to the wall of the building surrounding the opening such as a window; therefore, a person inside the building could see out of the window and receive a suitable amount of light without running the risk of unwelcome guests entering through the window.

In recent years, as in times past, several unfortunate incidents have occurred wherein grills or burglar bars were secured over the windows of a building. If a fire or other catastrophe occured while someone was in the building near a window having burglar bars, but away from a convenient exit such as a door, the burglar bars would retain the individual in the building and prevent their escape. Many persons have been consumed by fire while located adjacent an opening in a building through which they could not get out because of burglar bars that had been secured over the opening.

There have been several devices that are designed to act as grills or burglar bars that would be removable from the inside of the building, however, all of these devices have many inconveniences for one reason or another. Some of the devices required a padlock to be opened before the securing device could be removed from the opening. The padlocks were either a combination or a key type. The padlock would normally be located inside the window, but some of the padlocks were even located outside the window. Clearly in time of emergencies, such a retaining device that would require a key or a considerable amount of time to open is unsuitable for an emergency escape.

Other considerations are that the securing device should be strong enough so that they cannot be broken or bent by someone outside the window without going to such extremes as using a cutting torch or similar tools. Any type of locking device used to hold a grill into position should be out of the reach of someone outside the building. Since the windowpane can be very easily broken, it is desirable that the locking mechanism and the release thereof be located at some point outside of arm's length so that a locking device may not be operated by simply reaching through the grill and the broken windowpane.

SUMMARY OF THE INVENTION

Therefore, it is an object of this invention to provide a movable grill guard for covering an opening in a building.

It is another object of the present invention to provide a grill guard that would prevent the entering of a building through a window but would permit an occupant of the building to exit through the window in cases of emergency.

It is yet another object of the present invention to provide a grill guard for covering the window of a building with the grill guard being pivotally connected so that the lowermost portion of the grill guard may pivot outward allowing someone from inside the building to escape therefrom.

It is even another object of the present invention to provide a quick release locking mechanism for holding the pivotal portion of the grill guard securely over the window, yet allow a quick disconnect of the locking mechanism.

It is yet another object of the present invention to provide a locking device to hold the swinging portion of a pivotally connected grill guard into position by a rotating type locking means that cannot be operated from outside the building.

It is even another object of the present invention to provide a grill guard pivotally connected at the top with the lower portion being retained by an abutting loop bar that is pinned into position by a quick release locking means operable inside of the building.

DESCRIPTION OF THE PREFERRED EMBODIMENT

Figure 1:
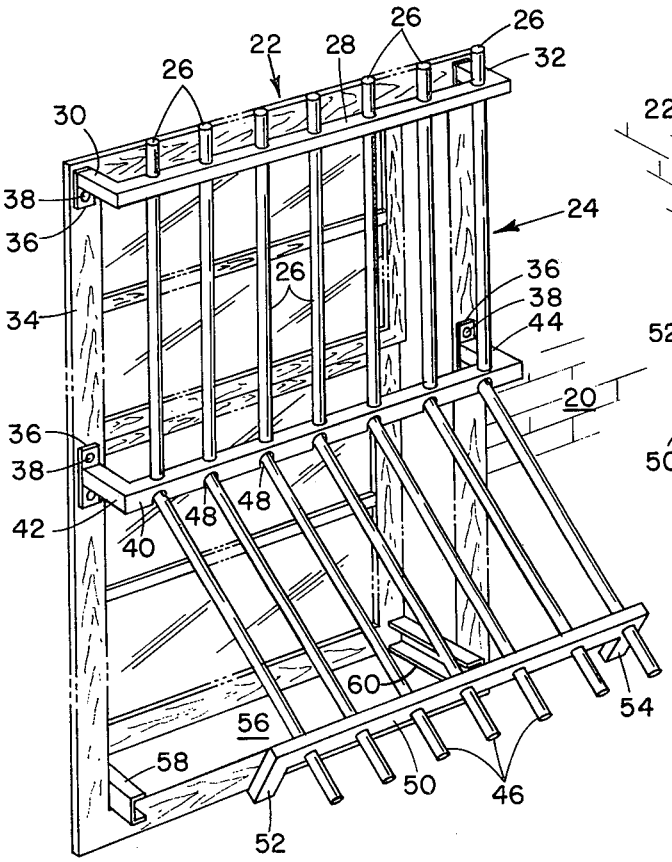
FIG. 1 is a pictorial view of the grill guard with the lower portion swinging freely.

Referring now to FIG. 1, there is shown a builidng 20 having a window 22 covered by grill guard 24. The grill guard 24 has a series of vertical bars 26 that are secured to a cross member 28 by any conventional means such as welding. The cross member 28 has two inward members 30 and 32 that are secured to the frame 34 of the window 22, or to the side of the building 20 by any conventional means. One means by which the inward members 30 and 32 may be attached to frame 34 would be by flanges 36 having a one way screw 38 extending therethrough.

At approximately the center of window 22 another cross member 40 again has inward members 42 and 44 for attaching to frame 34 of window 22 by means of flanges 36 and one way screws 38. The vertical bars 26 are securely fastened to the cross member 40 by any conventional means, such as welding, as will be explained in more detail subsequently. Pivoting bars 46, which normally extend downward from cross member 40 are connected thereto by means of a cross member (not shown) through notches 48 as will be explained in more detail subsequently. Another cross member 50 is located near the lower portion of pivoting bars 46 and again has inward members 52 and 54. The pivoting bars 46 are attached to cross member 50 by any conventional means such as welding.

By construction of the grill guard in the manner just described, the vertical bars 26 are very securely fastened into position by cross members 28 and 40 and pivoting bars 46, which pivot along the axis of cross member 40, are allowed to pivot as a unit by cross member 50. The bars 26 and 46 may be located as close together as necessary to prevent the entry into building 20 through window 22. As many cross support members as are necessary to give adequate support for the vertical bars 26 and pivoting bars 46 may also be used.

When allowed to hang freely, pivoting bars 46 will come to rest in the vertical position with inward members 52 and 54 being close to the frame 34 of window 22. On the window sill 56 of window 22 in the opposing corners are located channels 58 and 60 that are secured into the frame 34 as will be explained in more detail subsequently.

Figure 2:
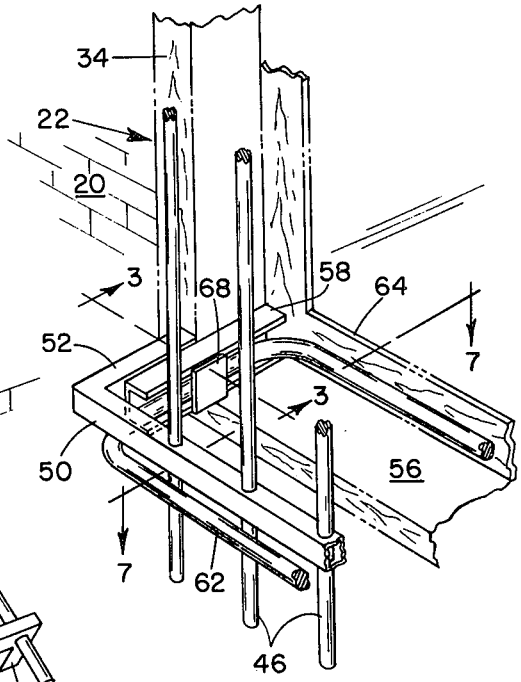
FIG. 2 is a perspective sectional view of the lower left hand corner of FIG. 1 illustrating how the grill guard is retained into position to prevent pivotal motion of the lower portion.
Figure 3:
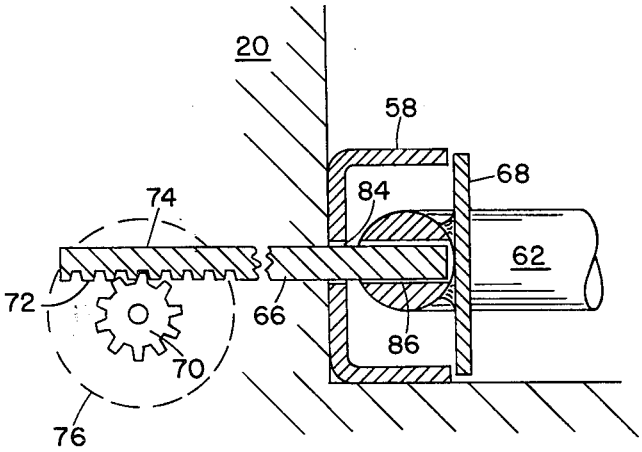
FIG. 3 is a sectional view of FIG. 2 alon section lines 3—3.

Referring now to FIG. 2, which is a cross sectional view of the lower left hand corner of FIG. 1 with pivoting bars 46 in the vertical position, inward member 52 rests against frame 34 of window 22 or against the side of the building 20. Immediately below the cross member 50 is located a loop bar 62, which abuts pivoting bars 46. The smaller sides of the rectangle formed by loop bar 62 are contained within channels 58 and 60 with the front of the loop bar abutting the inner frame 64 of window 22. The loop bar 62 is held into position by a pin 66 shown in FIG. 3 and covered by plate 68. The loop bar 62 is designed so that the pivoting bars 46 are secured between loop 62 and the outward force of inward members 52 and 54 butting against frame 34. Since loop bar 62 only abuts pivoting bars 46 and is not connected thereto, when pin 66 is removed by rotation of cog 70 which operates against gears 72 that are formed integral with the shaft portion 74 of pin 66, the loop bar 62 is no longer secured into position.

Referring back and forth between FIGS. 1, 2, 6 and 7, the operation of the locking device for the burglar bars in the present invention can best be shown. By the turning of the knob 76 located inside the building 20 which is attached to shaft 78, cog 70 will also be turned. When inside the building 20 and facing knob 76 it should be turned in the clockwise direction to release the loop bar 62. By turning in the clockwise direction, shaft 78 and cog 70 will also rotate in the clockwise direction. Because the teeth in cog 70 mate with gear 72 of shaft portion 74, the clockwise rotation will move the shaft portion 74 and the pin 66 away from the loop bar 62. (By placing cog 70 above the shaft 74, counterclockwise rotation could have been used instead.) One simple flip of the knob 76 should be sufficient to remove pin 66 from loop bar 62. Thereafter, a person could raise the inner frame 64 and the windowpane and push against pivoting bars 46. Since loop bar 62 is no longer retained into position by pin 66, it is free to slide out of channels 58 and 60. Therefore, a light amount of force against pivoting bars 46 will pivot the lower grill outward about cross member 40 carrying loop bar 62 with the pivoting bars 46. As loop bar 62 slides out of the channels 60 and 58, it is free to drop to the ground as pictorially represented in FIG. 6; thereby, allowing someone inside building 20 to escape therefrom in case of an emergency.

It should be realized that knob 76, which controls the locking mechanism to hold loop bar 62 into a rigid position, may be located anywhere that is inaccessible to a person outside of building 20. Though a pin or lever type of mechanism could have been used to lock loop bar 62 into position, a rotating type of device was preferred to prevent someone from reaching inside the building with a rod or fishing pole type device to operate a lever type of mechanism.

Figure 4:
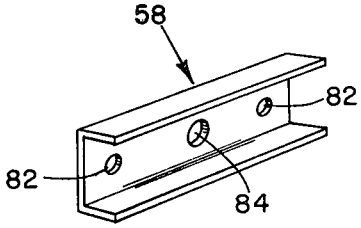
FIG. 4 is a perspective view of the retaining channel used in the present invention.
Figure 5:
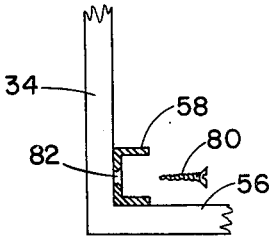
FIG. 5 is a sectional view illustrating how the retaining channel shown in FIG. 4 is attached inside the window frame.
Figure 6:
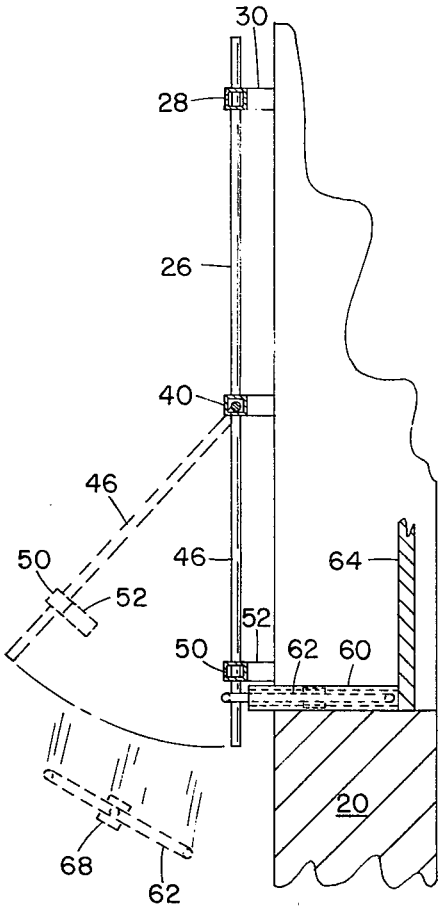
FIG. 6 is a sectional view of FIG. 7 along section lines 6—6.

Referring now between FIGS. 4 and 5 of the present invention, there is shown the channel 58 and how it is connected to frame 34 by means of flat head screws 80 through countersunk holes 82 in channel 58. Also, hole 84 allows the pin 66 to slide therethrough and into position in the hole 86 drilled into loop bar 62 (See FIG. 3). Plate 68 prevents someone from pushing pin 66 out of hole 86.

Figure 8:
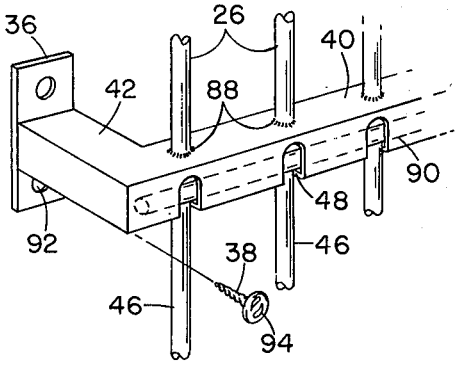
FIG. 8 is a perspective view of the pivoting mechanism shown in FIG. 1.
Figure 7:
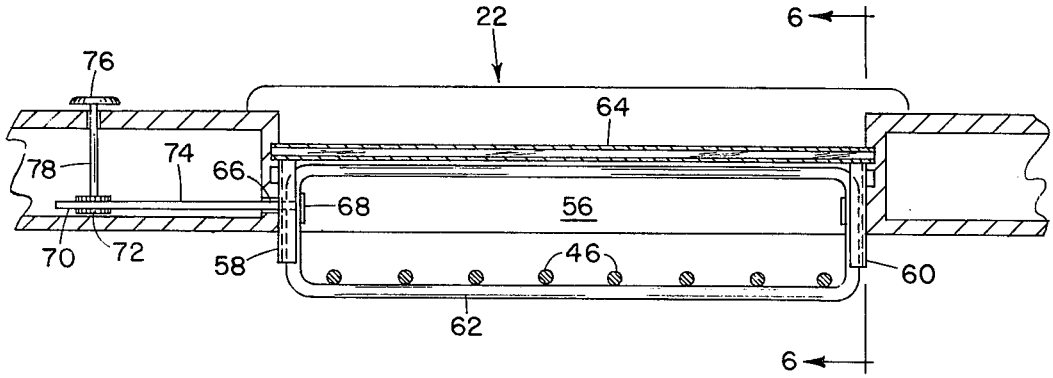
FIG. 7 is a sectional view of FIG. 2 along section lines 7—7.

Referring now to FIG. 8 of the drawings, there is shown the cross member 40 about which the lower portion of the grill guard 24 rotates. The vertical bars 26 are attached to the cross member by any conventional means such as a weld 88. Inside of cross member 40, which is formed from a hollow steel bar, is contained a cross rod 90. To the cross rod 90 are connected pivoting bars 46 in any conventional manner such as welding. The slots 48 extend approximately one fourth of the distance around cross member 40, thereby, allowing pivoting bars 46 to pivot outward and upward when necessary to escape from the inside of building 20. The inward member 42, which forms a part of cross member 40, is attached to the building 20 by means of flange 36 containing holes 92 through which one way screws 38 are inserted. The one way screw 38 has a ridge 94 on each side of the head allowing the screw to be screwed in, but being impossible to remove by ordinary means such as a screw driver.

Figure 9:
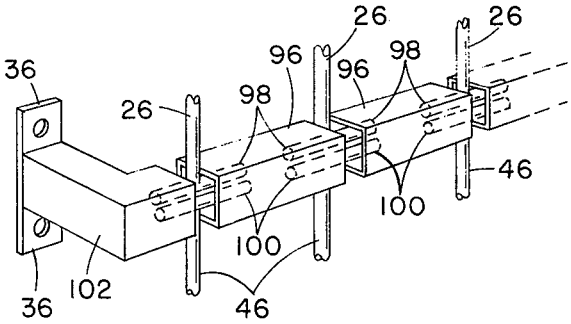
FIG. 9 is an alternative pivoting mechanism to the one shown in FIG. 8.

An alternative method of providing for the pivotal motion of the lower portion of the grill guard 24 is shown in FIG. 9. The cross member 40 of FIG. 8 has been replaced by a series of short cross members 96. Each of the vertical bars 26 is also connected to a short cross bar 98 that is contained within short cross members 96. Also contained within the short cross members 96 are short cross bars 100, which are attached to pivoting bars 46. At the end of the series of short cross members 96 is contained an angle member, 102, which contains the last of the short cross bars 98 and 100 and is attached to flanges 36 and to the frame 34 in the usual manner. Because of the rigid position of the opposing angle members 102 and the short cross bars 98 and 100 being contained in the short cross members 98, the same rigid structure as formed by cross member 40 has now been formed by a series of components without the requirement for welding of pivoting bars 46 to cross rod 90 while contained within cross member 40.

Figure 10:
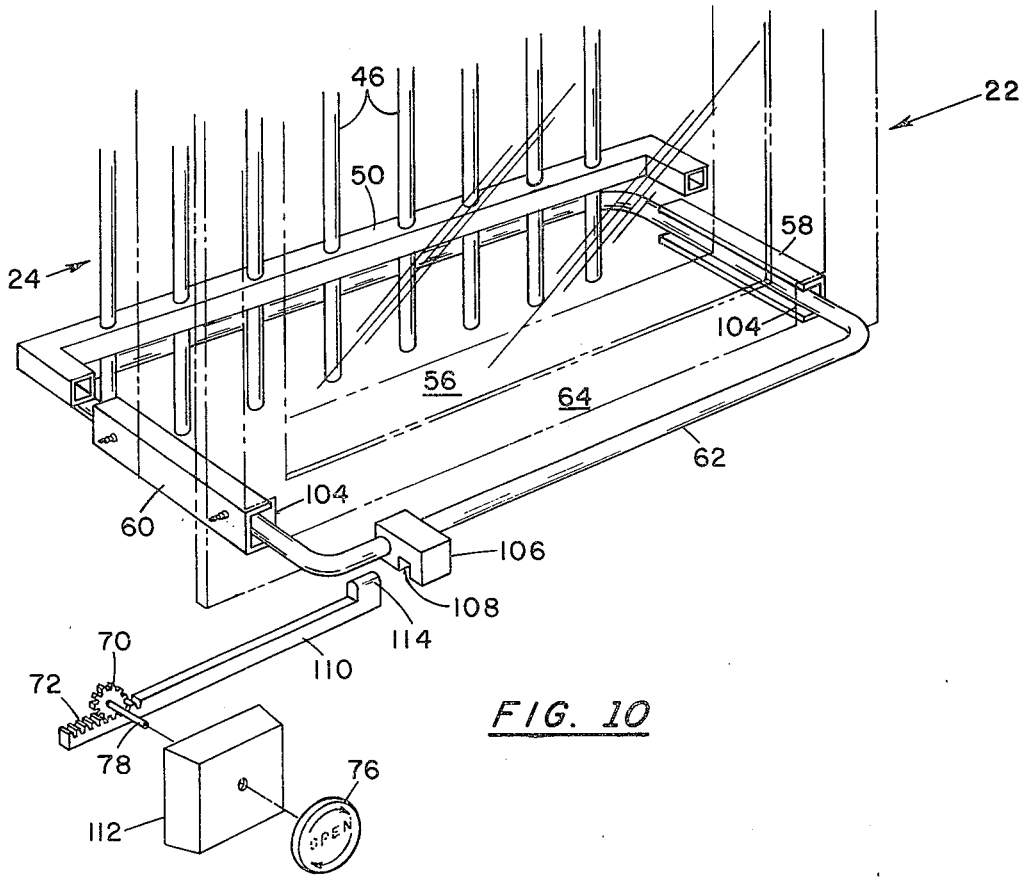
FIG. 10 is an alternative embodiment of the present invention.

Referring now to FIG. 10 of the drawings, there is shown an alternative embodiment for the grill guard 24 wherein the loop bar 62 and channels 58 and 60 extend through a notch 104 cut in the corners of the inner frame 64 of window 22. By construction in this manner the channels 60 and 58 may be longer to provide additional support for the loop bar 62, and the loop bar 62 now extends in front of the inner frame 64 to the inside portion of window sill 56. The channels 58 and 60 may either terminate at notch 104 or may also extend therethrough to provide additional support. Connected by conventional means such as welding to the inside portion of loop bar 62 is retaining block 106 having a notch 108 cut therein. A sliding rod key 110 and upper portion 114 slideably mates with notch 108 to retain loop 62 in a rigid position. The sliding rod key 110 is again controlled by cog 70 mating with gears 72 and controlled by knob 76 connected to shaft 78. A cover plate 112 has been provided to cover the cogs and gear portion of sliding rod key 110.

It should be realized that as many retaining blocks 106 as are necessary to provide a rigid support of loop rod 62 may be used with the whole series of them being located across the front of window sill 56. The sliding rod key 110 could be continuous with the upper portions 114 mating in the respective notches 108 of the retaining blocks 106.

Figure 17:
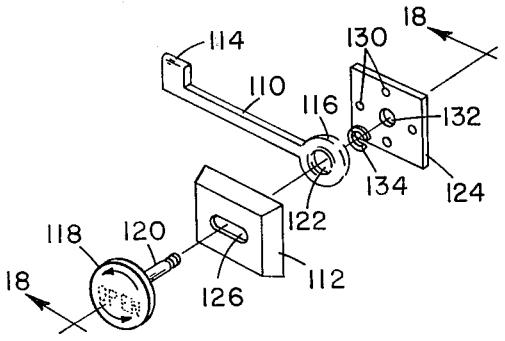
FIG. 17 is an alternative embodiment for the locking device and may be used in conjunction with FIG. 10.
Figure 18:
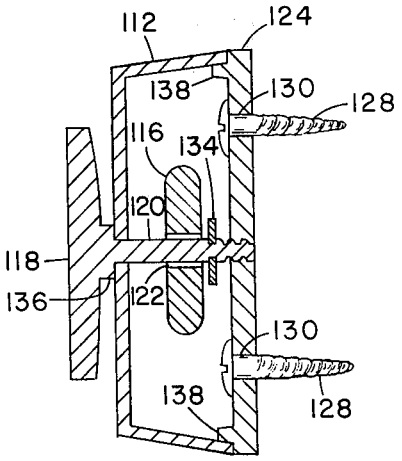
FIG. 18 is a sectional view of FIG. 17 along section lines 18—18.

Referring now to FIGS. 17 and 18 is combination, there is shown an alternative type of locking means other than using mating gears on a cog or a ratchet type of system. In FIG. 17, the sliding rod key 110 has a doughnut shaped end 116 through which screw 120 of knob 118 would insert. The screw 120 is formed as an integral part of the knob 118. The hole 122 in doughnut shaped end 116 is larger than the threads on the screw 120 so that screw 120 may be freely inserted therethrough. The cover plate 112 contains a slot 126 through which the screw 120 can also be freely inserted. To the rear of the doughnut shaped end 116 is a mounting plate 124 that is attached to the wall by means of screws 128 through holes 130. The center of the mounting plate 124 has a threaded hole 132 for receiving screw 120. The threads on screw 120 and in threaded hole 132 should be very steep so that about a half turn of the knob 118 would release the screw from the mounting plate 124. Clip ring 134 would prevent screw 120 from being pulled out of hole 122 of doughnut shaped end 116. After releasing screw 120 from mounting plate 124, screw 120, knob 118 and sliding rod key 110 may be moved in the horizontal direction to the right (or left according to how it is mounted) thereby moving upper portion 114 out of contact with notch 108. The slot 126 allows the screw 120 to slide in cover plate 112. Though there are many ways of holding the cover plate 112 into position, the present invention uses a shoulder 136 of screw 120 butting against the front of the cover plate 112 with shoulders 138 of the mounting plate 124 holding the cover plate over the mounting plate 124.

Figure 14:
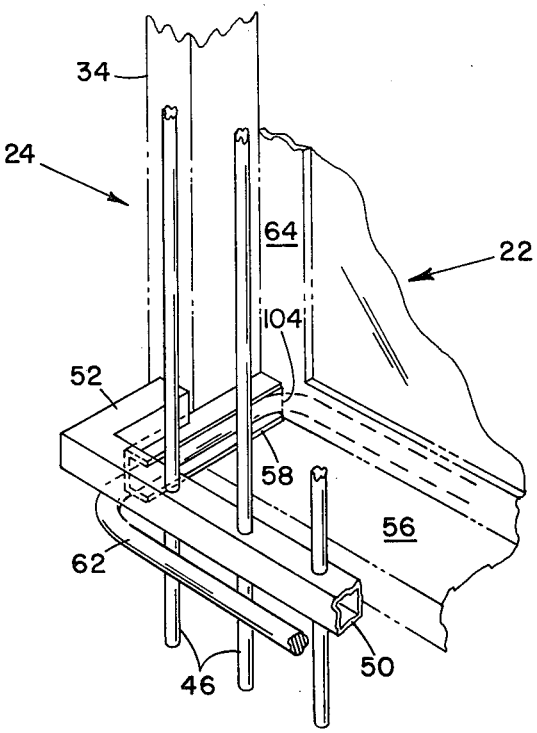
FIG. 14 is alternative embodiment of the present invention.
Figure 15:
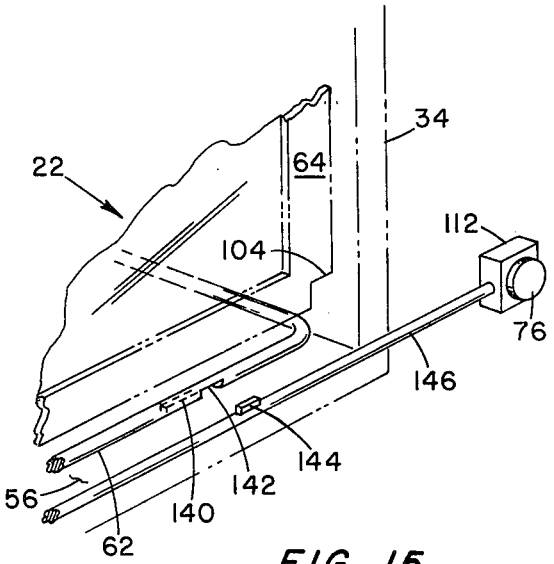
FIG. 15 is a locking mechanism that may be used with FIG. 14.

Referring now to FIG. 14, there is shown an outside view of the grill guard 24 wherein the loop bar 62 extends through the notch 104 cut in the inner frame of the window 22. The channel 58 terminates outside of the inner frame 64. Referring now to FIG. 15, there is shown a different type of locking mechanism for FIG. 14. In the loop bar 62 are cut notches 140 with opening slots 142. When the grill guard 24 is in position and loop bar 62 is in its innermost position, opening slot 142 will slide over ridge 144 of securing bar 146. The securing bar 146 will be operated by the control knob 76 in a manner similar to those previously described or any other conventional manner. A cover plate 112 again encloses the internal workings of the locking mechanism. As many notches 140, opening slots 142 and ridges 144 as are necessary to adequately secure the loop bar 62 into position may be used across the inside of window sill 56.

Figure 11:
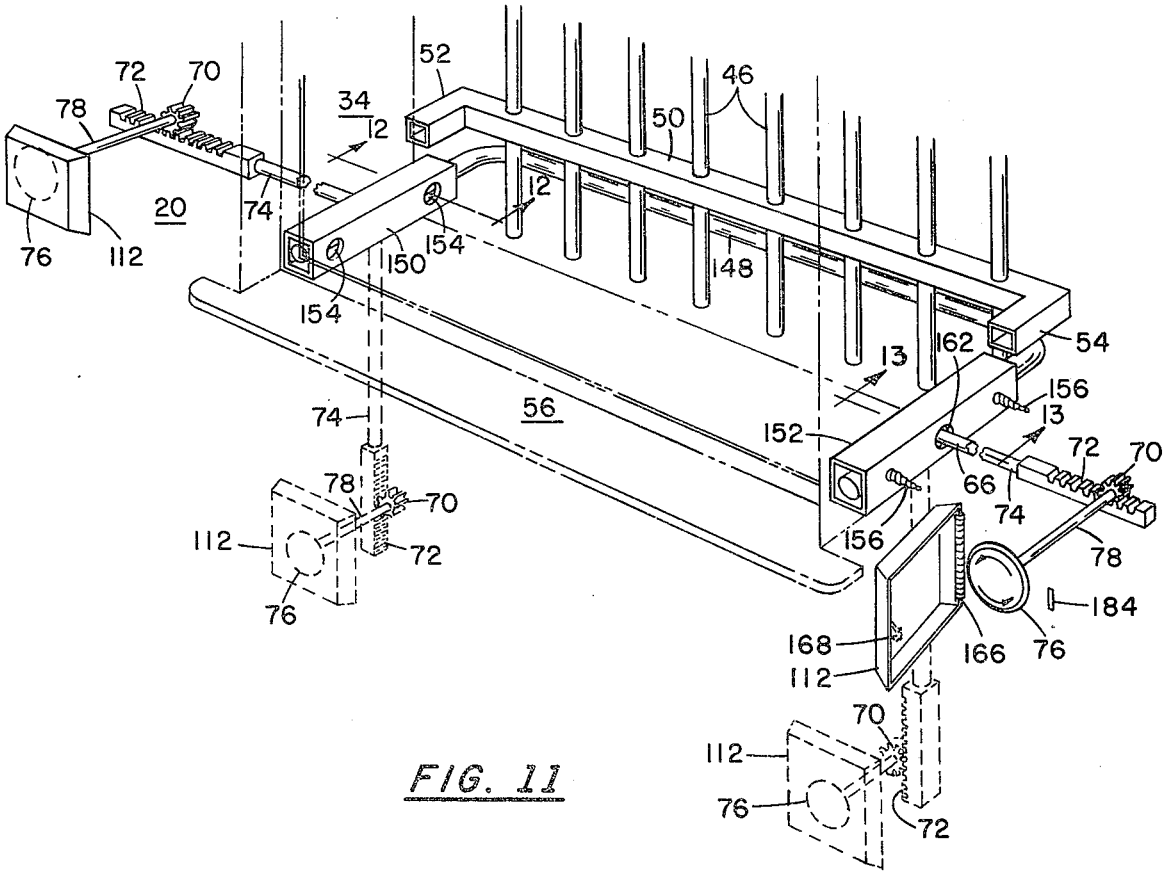
FIG. 11 is another alternative embodiment of the present invention.
Figure 12:
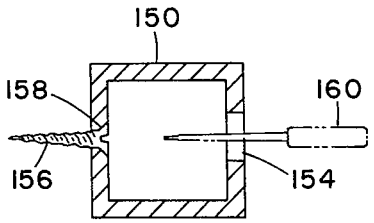
FIG. 12 is a sectional view of the hollow bar in FIG. 11 along section lines 12-12 illustrating how the hollow bar is mounted.
Figure 13:
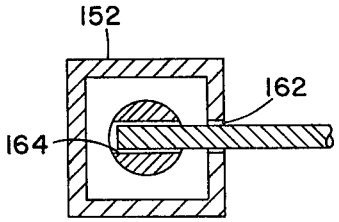
FIG. 13 is a sectional view of FIG. 11 along section lines 13—13.

To satisfy the customer who may not prefer that the loop bar extend across the inside or the outside of the window sill 56, an alternative design is shown in FIG. 11. In FIG. 11, the loop bar 62 has now been replaced with a U-shaped bar 148 that extends into hollow bars 150 and 152 formed of a substance similar to cross member 50. To secure the hollow bars 150 and 152 into position, holes 154 have been cut therein through which flat head screws 156 may be inserted and screwed through inner hole 158 into frame 34 of the window 22 by screw driver 160 as shown in FIG. 12. The inside portion of hollow bars 150 and 152 have a hole 162 through which the pin 66 of shaft portion 74 may be inserted in the usual manner (See FIG. 13). In the same manner as the loop bar 62, the U-shaped bar 148 has a hole 164 drilled therethrough to receive pin 66. Again pin 66 is controlled by cog 70 that operates against gears 72 when turned by knob 76 and shaft 78. The only part visible from inside the building would be cover plate 112 with the knob 76 being thereunder and the remaining gearing and locking mechanism being buried in the wall of the building. Two locking mechanisms are used on each of the windows for additional support because of the leverage that could be exerted against a single pin 66 by pulling on the opposite side of U-shaped member 148. This leverage that could be exerted on the pin could either bend or break the locking mechanism thereby allowing someone outside the building 20 to break in through the window 22.

The cover plate 112 may be contained on hinges 166 with a snap latch 168 and have the knob 76 contained therein to provide the minimum amount of conflict with the decor of the inside of the building. Also, if there is not enough space at the edge of the window 22 to locate the locking mechanism out of the reach of someone outside of the building 20, it may be located under the window sill 56 in the manner illustrated in phantom lines and given the same numerical representation as the previously described locking mechanism. The only difference would be that hole 162 would have to be cut in the bottom of hollow bars 150 and 152 and vertically through U-shaped member 148.

Figure 16:
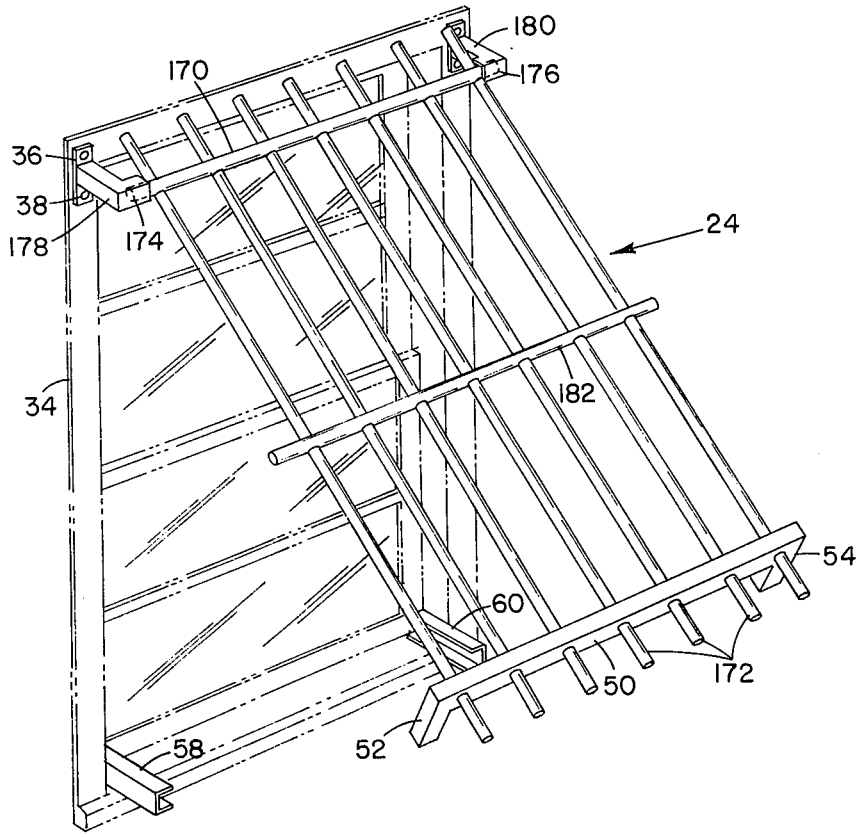
FIG. 16 is an alternative embodiment of the pivoting mechanism shown in FIG. 1.

Referring now to FIG. 16 of the drawings, there is shown an alternative embodiment where the entire grill guard 24 may be pivoted about an upper cross bar support 170. Each of the full length vertical bars 172 will be attached to upper cross bar support 70 by means of welding or other conventional means. The upper cross bar support 70 extends beyond the outermost full length vertical bars 172 by a short distance. This short distance on each end of upper cross bar support 170, which is numbered 174 and 176, is retained inside of hollow angle bars 178 and 180, respectively. Angle bars 178 and 180 are attached to the frame 34 in the conventional manner by means of flanges 36 and one way screws 38. The center section of the vertical bars 172 also has a cross bar support 182 attached thereto in a conventional manner such as welding to give additional strength. The lower portion of the full length bars 172 has a cross member 50 and inward members 52 and 54 as described in the conventional manner. The pivoting action of the full length vertical bars 172 will be controlled in the previously described manner by means of a loop bar being retained within channels 58 and 60 and locked by one of the previously described locking mechanisms or other conventional means. The pivoting motion of the entire grill guard 24 allows for easy cleaning of the outside windows, plus it may be more economical to manufacture.

Though many other types of locking mechanisms could have been shown wherein the pivoting motion of the lower grill guard is controlled by the locking mechanism, the ones previously described were considered a typical example.

Figure 19:
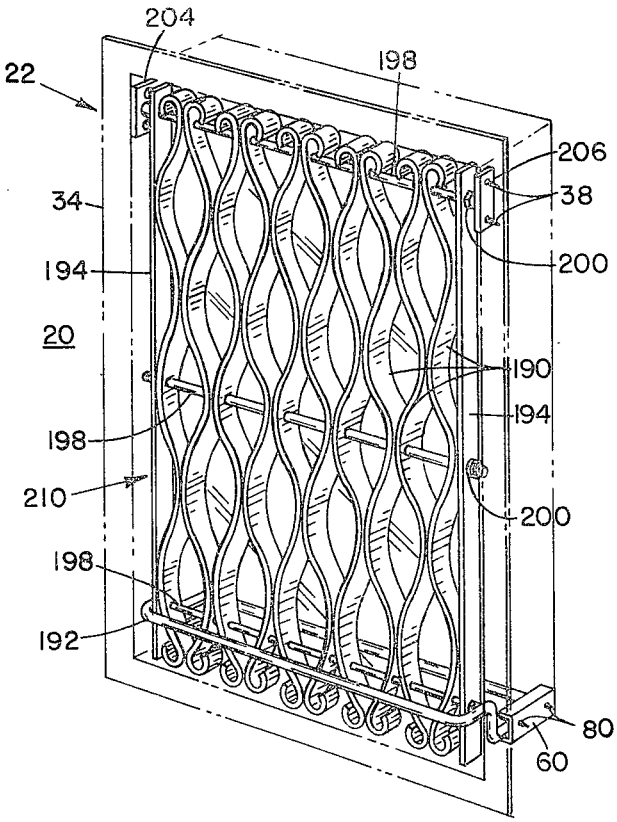
FIG. 19 is a perspective view of an alternative type of grill guard.
Figure 22:
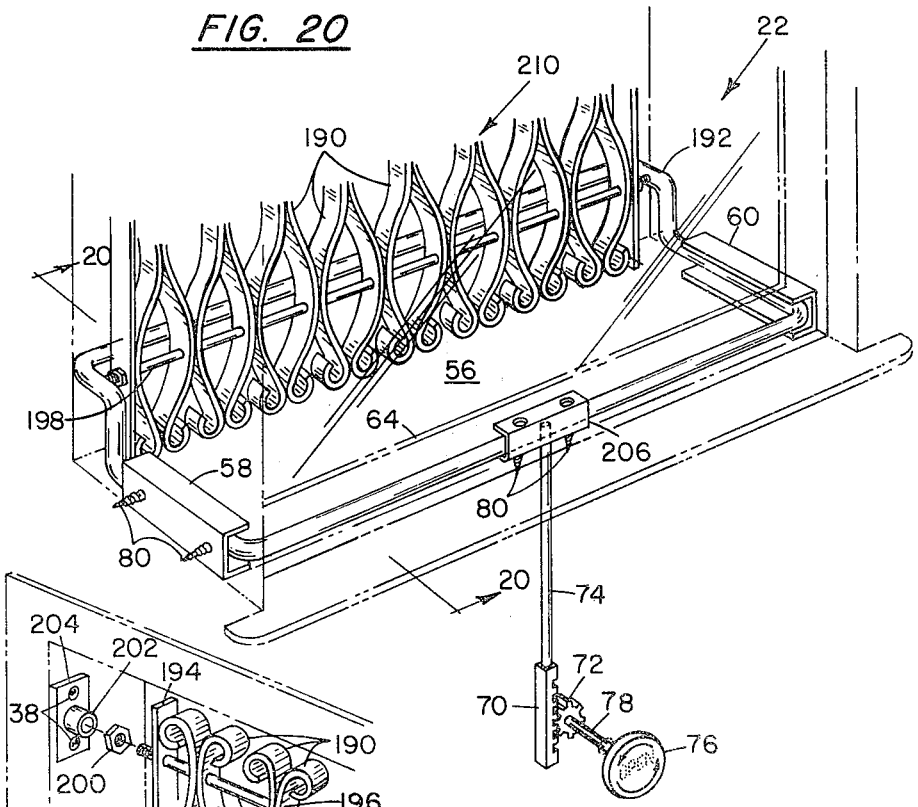
FIG. 22 is an enlarged inside view of the lower portion of FIG. 19 and the locking mechanism.
Figure 21:
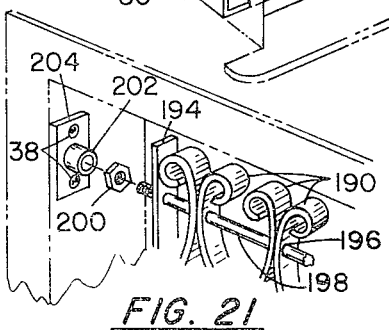
FIG. 21 is a partial assembly view of the pivoting mechanism used in FIG. 19.
Figure 23:
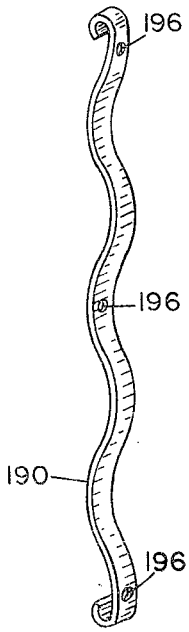
FIG. 23 is a perspective view of a single rib for the grill guard shown in FIG. 19.

For the individual who desires a more decorative type of grill guard, FIG. 19 shows a logical alternative embodiment of the present invention. Referring to FIGS. 19–23 in combination, there is shown a decorative grill guard 210 made from a series of matching ribs 190. The ribs 190 which are all identical have a wave pattern with a decorative curl at the upper and lower portion. Holes 196 are cut in ribs 190 to receive the cross members as will be subsequently explained. To install the decorative grill guard 210 all that a workman has to do is to have ribs 190 of the correct length to fit window 22. The decorative grill guard is assembled by a series of rods being inserted through the respective holes 96 of ribs 190. The ribs 190 face in opposing directions to give it the honeycomb type of effect shown in FIG. 19. A flat metal strip 194 is contained over the outside of ribs 190 once a sufficient amount of ribs have been assembled to cover window 22. The cross rods 198 are threaded on the ends and nuts 200 attach thereto to provide a rigid decorative grill 210. The center cross rod 198 is included to give additional support but may not be necessary to smaller windows. The center and the lower cross rods 198 are bradded on the ends to prevent nuts 200 from being removed.

The decorative grill guard 210 which is contained inside of the window frame 34 is retained at the uppermost portion by mounting bracket 204 having a cylinder 202 attached thereto by conventional means such as welding. The ends of upper cross rod 198 that extend as welding. The ends of upper cross rod 198 that extend beyond nut 200 will be contained with cylinder 202. The entire decorative grill guard 210 is then inserted inside the window along with mounting brackets 204 and cylinders 202 as shown in FIG. 19. The mounting brackets 204 are attached to the walls of window frame 34 by means of one way screws 38. The decorative grill guard 210 is allowed to rotate inside of cylinder 202 about the upper cross rod 198.

Figure 20:
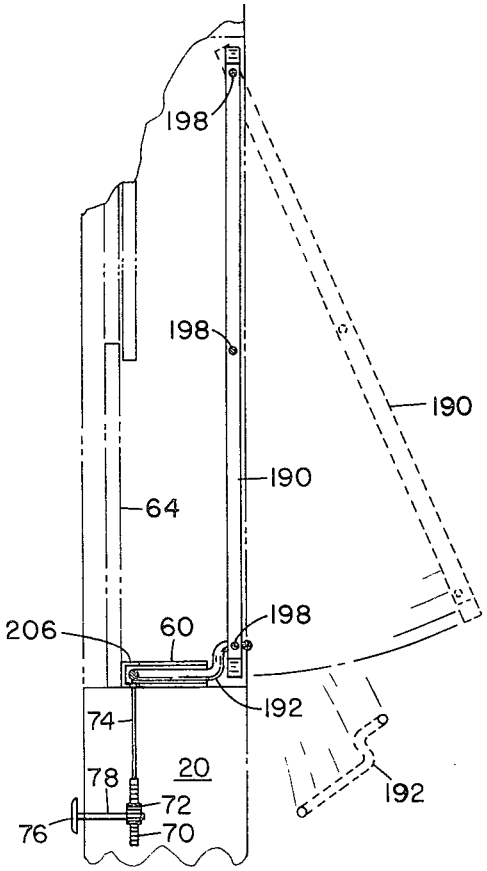
FIG. 20 is a sectional view of FIG. 22 along section lines 20—20.

The locking mechanism for the alternative embodiment shown in FIGS. 19–23 is similar to the locking mechanism shown in the prior embodiments. Again the channels 58 and 60 retain the loop bar 192 against the lower portion of the decorative grill guard 210 to prevent the pivotal motion thereof. The channels 58 and 60 are retained into position by countersunk screws 80 as previously described. The loop bar 192 is held into position by shaft 74 connected to cogs 70 and gears 72 that are operated by shaft 78 and knob 76, as described in the previous embodiments. Insertion of the pin portion of shaft 74 into loop bar 192 (not shown) is protected by channel 206 held into position by countersunk screws 80. Channel 206 and loop bar 192 are located immediately outside inner window frame 64. By rotating knob 76 in the counterclockwise direction, shaft 74 will move downward freeing loop bar 192. By raising the window and pushing out on ribs 190, the decorative grill guard 210 will pivot about upper cross rod 190 as illustrated in FIG. 20. The loop bar 192 will fall freely to the ground.

To prevent the loop bar 192 from covering the decorative swirls of ribs 190 an offset has been included in the loop bar 192. This same type of effect could be accomplished in a number of ways, with the particular choice being left to the individual. Also, the point where the loop bar 192 is pinned is located in the center of the window sill 56. This prevents a torque from being exerted on the pin as may be possible on the designs wherein one pin is located on the side of the loop bar.

The individual ribs 190 should be only thick enough so that when assembled in the honeycomb type of manner to form grill guard 210, they will have the strength required to prevent unauthorized entry through window 34.

The design shown in FIGS. 19–23 is extremely simple to manufacture and to install. The manufacturer could make a series of varying length grill bars 190 to match the height of standard windows. To get the desired width all that is necessary is to add additional ribs 190. The cross rods 198 can be cut and threaded by the installer to the required length. Hence, the only variation from window to window would be the ribs 190 which would depend upon the height of the window. Such a design has the ultimate in simplicity of manufacturing and installation, plus providing the desired result of burglar protection and a means for exit in case of emergency.

Many other types of design embodying the principles set forth in conjunction with FIGS. 19–23 are possible and have the same decorative type of effect. The embodiment shown is to pictorially illustrate the utilization of the present invention with decorative grill guards.

What is claimed is:

1. Means for securing an opening in a building against entry without preventing an exit therefrom, said securing means comprises;

grill means extending substantially vertical over said opening;

means for attaching said grill means to said building, said attaching means allowing pivotal movement of the lowermost portion of said grill means about said attaching means;

structure means for holding the lowermost portion of said grill means over said opening by preventing said pivotal movement, and quick release locking means hand operable only inside said building and offset at least a predetermined distance from said opening to prevent operation from outside said building, said quick release locking means securing said structure means into position, upon release of said quick release locking means from inside said building, said structure means will allow said pivotal movement of said lowermost portion of said grill means to allow exit from said building through said opening.

2. The securing means as given in claim 1 wherein said structure means movably engages said grill means, said structure means being separable from said grill means upon pivoting the lowermost portion of said grill means.

3. The securing means as given in claim 2 wherein said structure means includes loop means for holding said grill means, said quick release locking means securing said loop means against said grill means.

4. The securing means as given in claim 3 wherein said quick release locking means is rotatably operable to release said loop means of said structure means, thereby allowing the lower portion of said grill means to move outward in a pivoting manner.

5. The securing means as given in claim 4 wherein said loop means is a bar looped around the lower portion of said grill means, said looped bar being retained in channels at the bottom of said opening and secured by a sliding bar of said locking means merging therewith.

6. The securing means as given in claim 5 wherein said locking means moves said sliding bar with cogs on a rotating member mating cogs on said sliding bar.

7. The securing means as given in claim 2 including a hollow horizontal bar for forming part of said attaching means, vertical bars of said grill means being attached to a cross bar within said hollow horizontal bar and allowed to rotate about said cross bar by slots in said hollow horizontal bar to give said pivoting motion of said grill means.

8. The securing means as given in claim 7 wherein said horizontal bar is located at approximately the middle of said grill means.

* * * * *